US010582739B2

(12) United States Patent
Faucher et al.

(10) Patent No.: US 10,582,739 B2
(45) **Date of Patent: *Mar. 10, 2020**

(54) SKATE BOOT AND METHOD OF MANUFACTURE

(71) Applicant: SPORT MASKA INC., Montreal (CA)

(72) Inventors: Alexis Faucher, Laval (CA); Alexandre Huneau, Fabreville (CA); Manuel Bergeron Piette, Montreal (CA)

(73) Assignee: SPORT MASKA INC., Montreal, Quebec ( * ) Notice: Subject to any disclaimer, the term of this patent is extended or adjusted under 35 U.S.C. 154(b) by 62 days.

This patent is subject to a terminal disclaimer.

(21) Appl. No.: 16/039,903

(22) Filed: Jul. 19, 2018

(65) Prior Publication Data

US 2018/0325209 A1 Nov. 15, 2018

Related U.S. Application Data

(63) Continuation of application No. 15/212,681, filed on Jul. 18, 2016, now Pat. No. 10,039,341.

(51) Int. Cl.

| | |
|---|---|
| ***A43C 11/00*** | (2006.01) |
| ***A43B 5/16*** | (2006.01) |
| ***A43B 23/08*** | (2006.01) |
| ***A43C 5/00*** | (2006.01) |
| ***A43C 1/04*** | (2006.01) |

(Continued)

(52) U.S. Cl.

CPC ..... *A43B 5/1683* (2013.01); *A43B 3/0052* (2013.01); *A43B 5/002* (2013.01); *A43B 5/0427* (2013.01); *A43B 5/0435* (2013.01); *A43B 5/16* (2013.01); *A43B 7/141* (2013.01); *A43B 7/1495* (2013.01); *A43B 7/18* (2013.01); *A43B 23/081* (2013.01); *A43C 1/003* (2013.01); *A43C 1/04* (2013.01); *A43C 5/00* (2013.01); *A43C 11/00* (2013.01); *A63C 1/00* (2013.01)

(58) Field of Classification Search

CPC ..... A43B 7/1495; A43B 7/18; A43B 5/16; A43B 5/1683; A43B 5/0427; A43C 1/04; A43C 11/00

See application file for complete search history.

(56) References Cited

U.S. PATENT DOCUMENTS 5,269,078 A 12/1993 Cochrane
5,992,057 A 11/1999 Monti
(Continued)

FOREIGN PATENT DOCUMENTS

CA 2288477 11/1999

*Primary Examiner* — Ted Kavanaugh
(74) *Attorney, Agent, or Firm* — Norton Rose Fulbright Canada

(57) ABSTRACT

A skate boot includes a boot shell having first and second opposite side portions cooperating to define a foot receiving opening therebetween. The first and second side portions have a facing portion extending from the foot receiving opening. A band having a first end portion is received in the boot shell and attached to the boot shell at or adjacent the second side portion. The band extends across an interior of the boot shell and is slidingly received through an opening defined in the first side portion so as to have a second end portion of the band extending outside of the boot shell. The second end portion of the band defines an aperture for receiving a lace.

20 Claims, 7 Drawing Sheets

(51) Int. Cl.

| | |
|---|---|
| ***A43B 7/14*** | (2006.01) |
| ***A43B 5/00*** | (2006.01) |
| ***A43B 5/04*** | (2006.01) |
| ***A43B 7/18*** | (2006.01) |
| ***A43B 3/00*** | (2006.01) |
| ***A43C 1/00*** | (2006.01) |
| *A63C 1/00* | (2006.01) |

(56) References Cited

U.S. PATENT DOCUMENTS

| | | | | |
|---|---|---|---|---|
| 6,772,541 | B1 | 8/2004 | Ritter et al. | |
| 7,062,867 | B2 | 6/2006 | Meibock | |
| 7,343,701 | B2 | 3/2008 | Pare et al. | |
| 10,039,341 | B2 * | 8/2018 | Faucher ..... | A43B 5/0427 |
| 2005/0284001 | A1 | 12/2005 | Hoffman et al. | |
| 2007/0033836 | A1 | 2/2007 | Rasmussen | |

* cited by examiner

SKATE BOOT AND METHOD OF MANUFACTURE

CROSS-REFERENCE TO RELATED APPLICATIONS

The present application is a continuation of U.S. patent application Ser. No. 15/212,681 filed Jul. 18, 2016, the entire contents of which are incorporated herein by reference.

TECHNICAL FIELD

The application relates generally to skates and, more particularly, to boots for such skates.

BACKGROUND OF THE ART

A skate typically has a boot and a ground-engaging skate element such as a blade or a set of inline rollers attached to the underside of the boot. The skate is typically provided with a lace to secure the boot on a wearer's foot and ankle to provide a better fit between the foot and the boot for additional comfort and support.

Known straps to help further tighten the boot around the ankle can include complex mechanisms (e.g. pulleys) and/or may not provide a satisfactory support to secure the foot of the wearer inside the boot of the skate.

SUMMARY

In one aspect, there is provided a skate boot comprising: a boot shell including first and second opposite side portions cooperating to define a foot receiving opening therebetween, each of the first and second side portions having a facing portion extending from the foot receiving opening; and a band having a first end portion received in the boot shell and attached to the boot shell at or adjacent the second side portion, the band extending across an interior of the boot shell and being slidingly received through a band-receiving opening defined in the first side portion so as to have a second end portion of the band extending outside of the boot shell, the second end portion of the band defining an aperture for receiving a lace therethrough.

In another aspect, there is provided a skate comprising: a boot shell having two side portions cooperating to define a foot receiving opening therebetween; a ground-engaging assembly connected to a bottom of the boot shell; and two bands each having a first end portion received in the boot shell and attached to the boot shell, each band extending across an interior of the boot shell from a point adjacent a respective one of the two side portions and being slidingly received through an opening defined in the other one of the two side portions so as to have an opposed second end portion extending outside of the boot shell, the second end portion of each band defining an aperture for receiving a lace.

There is also provided a boot comprising: a boot shell including first and second opposite side portions cooperating to define a foot receiving opening therebetween, each of the first and second side portions having a facing portion extending from the foot receiving opening and a plurality of eyelets in each facing portion, the first side portion having an opening defined therethrough in the facing portion thereof; and a band having a first end portion received in the boot shell and attached to the boot shell at or adjacent the second side portion, the band extending across an interior of the boot shell and being slidingly received through the opening defined in the first side portion so as to have a second end portion extending outside of the boot shell, the second end portion of the band defining an aperture for receiving a lace.

There is further provided a skate comprising: a boot shell having two side portions each including a row of eyelets defined in an instep region thereof and a respective opening defined therethrough in proximity of the row of eyelets; a ground-engaging assembly connected to a bottom of the boot shell; and two bands each having a first end portion received in the boot shell and attached to the boot shell, each band extending across an interior of the boot shell from a point adjacent a respective one of the side portions and being slidingly received through the opening defined in the other one of the side portions so as to have an opposed second end portion extending outside of the boot shell, the second end portion of each band defining an aperture for receiving a lace.

In a further aspect, there is provided a method of manufacturing a boot, the method comprising: manufacturing a boot shell, including defining an opening in a first one of two opposed side portions of the boot shell in proximity of a respective row of eyelets; attaching a band inside the boot shell to or adjacent a second one of the two opposed side portions; slidingly extending the band through the opening defined in the first side portion; and positioning an aperture of the band outside of the boot shell.

The method as defined above may further include: defining an opening in the second side portion in proximity of a respective row of eyelets; attaching a second band inside the boot shell to or adjacent the first side portion; slidingly extending the band through the opening defined in the second side portion; and positioning an aperture of the second band outside of the boot shell.

There is further provided a boot comprising: a boot shell including first and second opposite side portions cooperating to define a foot receiving opening therebetween, each of the first and second side portions having a facing portion extending from the foot receiving opening and a plurality of eyelets extending through each facing portion, one of the eyelets in the first side portion forming an opening in the facing portion configured to receive a band therethrough, and the remaining eyelets in the first side portion adapted to receive a lace therethrough; and the band having a first end portion received in the boot shell and attached to the boot shell at or adjacent the second side portion, the band extending across an interior of the boot shell and being slidingly received through the opening defined in the first side portion so as to have a second end portion of the band extending outside of the boot shell, the second end portion of the band defining an aperture for receiving the lace.

There is further still provided a skate comprising: a boot shell having two side portions each including a row of eyelets defined in an instep region thereof, one eyelet in each of the row of eyelets forming an opening extending through a respective one of the side portions and receiving a band therethrough, and the remaining eyelets in the row of eyelets receiving a lace therethrough; a ground-engaging assembly connected to a bottom of the boot shell; and two bands each having a first end portion received in the boot shell and attached to the boot shell, each band extending across an interior of the boot shell from a point adjacent a respective one of the side portions and being slidingly received through the opening defined in the other one of the side portions so as to have an opposed second end portion extending outside of the boot shell, the second end portion of each band defining an aperture for receiving the lace, lace extending between the side portions through the remaining eyelets of each of the rows of eyelets and extending through each one of the apertures in the second end portions of the two bands.

DESCRIPTION OF THE DRAWINGS

Reference is now made to the accompanying figures in which.

DETAILED DESCRIPTION

Figure 1:
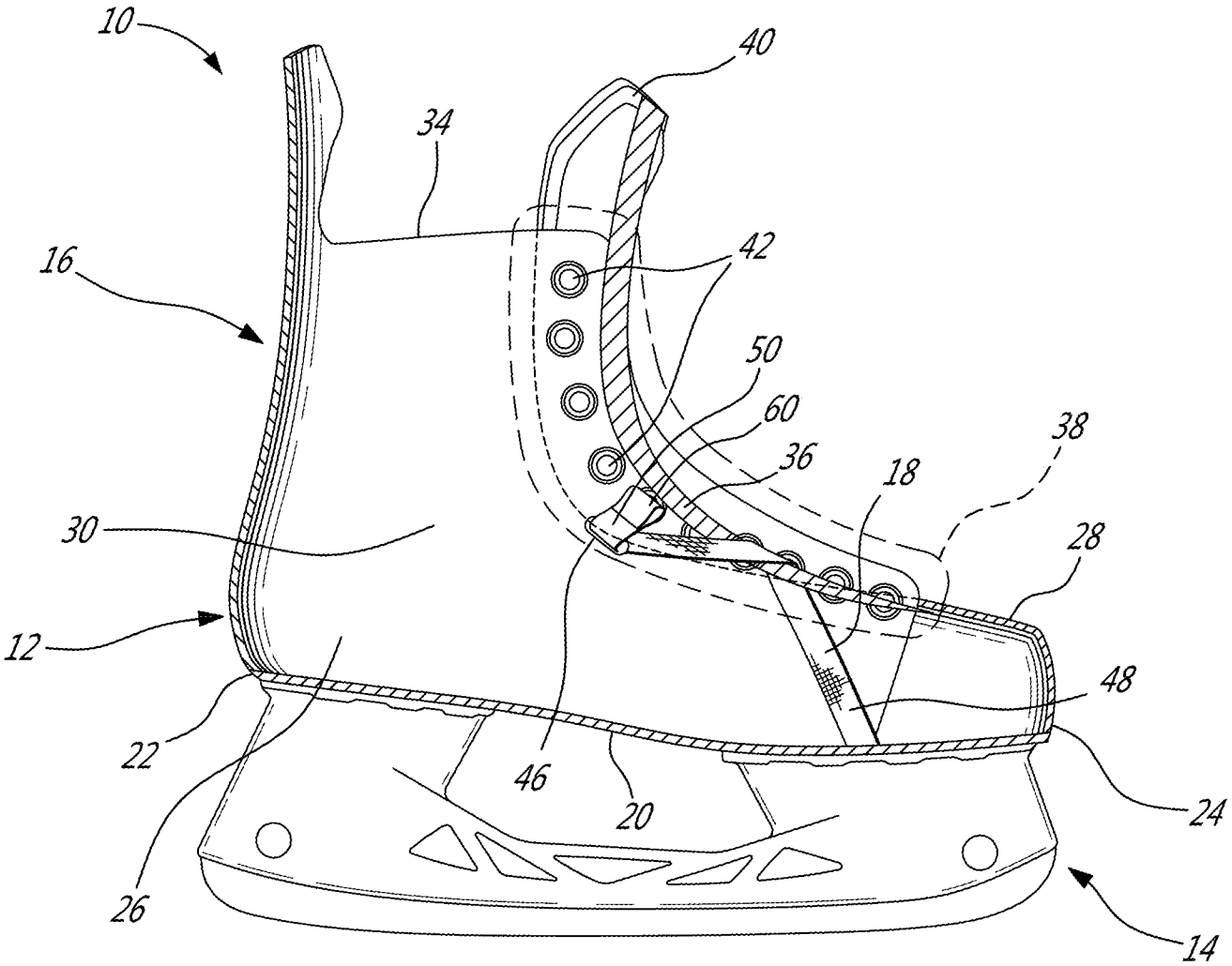
FIG. 1 is a schematic side view of a skate shown partly in transparency, in accordance with a particular embodiment.

Referring to FIG. 1, a skate 10 is generally shown. The skate 10 includes a boot 12 and a ground-engaging assembly 14, which is shown as including a blade. It is understood that the particular skate configuration shown here is provided as an example only and that alternate configurations are possible, including, but not limited to, other types of ground engaging assemblies such as roller skate ground engaging assemblies including rollers or wheels.

Figure 2:
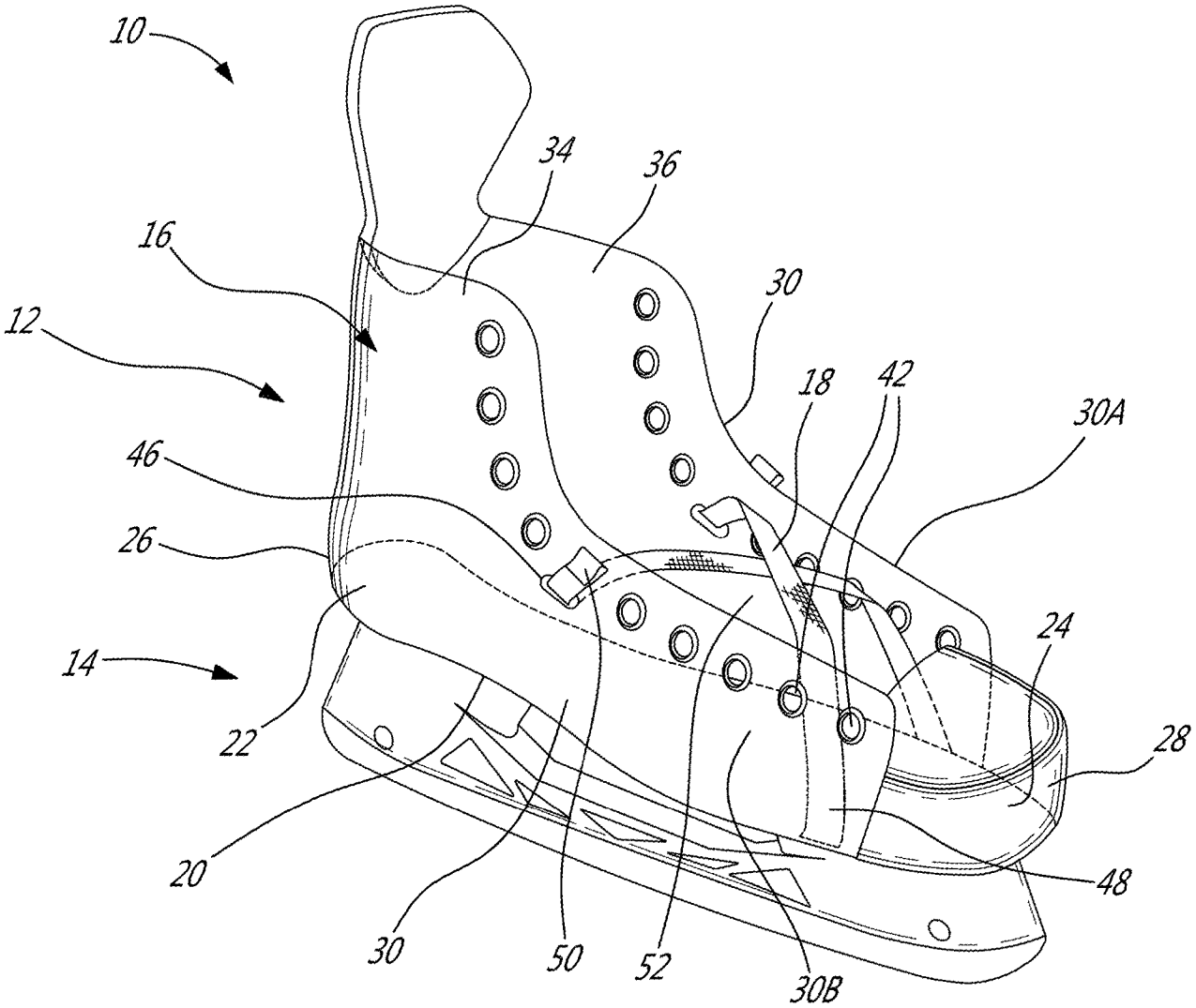
FIG. 2 is a schematic tridimensional view of an outer shell of the skate of FIG. 1.

Referring to FIGS. 1-2, the boot 12 generally includes a boot shell 16 and two support bands 18. The boot shell 16 includes a sole portion 20 that has back and front ends 22, 24. The sole portion 20 is connected to the ground-engaging assembly 14, and is shaped to receive the foot of the wearer thereon, in a particular embodiment with an inner liner and/or insole (not shown) extending between the sole portion 20 and the foot.

The boot shell 16 also includes a heel portion 26 extending from the back end 22 of the sole portion 20, for receiving a heel of the foot of the wearer. The heel portion 26 is generally curved to contour the heel and a rear of the foot.

The boot shell 16 also includes a toe portion 28 extending from the front end 24 of the sole portion 20, for receiving toes of the foot of the wearer. In the embodiment shown in FIG. 2, the toe portion 28 is defined by a toe cap formed separately from a remainder of the boot shell 16, and connected thereto. The toe cap 28 can be made from a hard or stiff material to protect the toes of the wearer. Other configurations are also possible.

The boot shell 16 further includes two opposite side portions 30 connected to the sole 20, heel 26 and toe 28 portions. The spaced apart side portions 30 define quarters and an instep portion of the boot shell 16, and cooperate together to surround the foot of the wearer. The two side portions 30 surround a foot receiving opening 34 of the boot shell 16. Each side portion 30 has an instep region 36, defining a boundary or edge of the side portion 30 along an instep of the foot. In the embodiment shown, each instep region 36 extends between the foot receiving opening 34 and the toe portion 28. The edge of the instep region 36 has an L-shaped form, when viewed from the side, with a vertical or substantially vertical portion thereof near the foot receiving opening 34 and a horizontal or substantially horizontal portion thereof near the toe portion 28.

A row of eyelets 42 is defined in each instep region 36. The eyelets 42 are formed by holes defined through the side portions 30 and bordered by a suitable reinforcement ring (e.g. metal or plastic), and are configured to receive a lace 44 (FIG. 3) therethrough. The lace 44 is threaded through the eyelets 42 across the side portions for fastening the side portions 30 closer together thereby securing the boot shell 16 onto the foot. In the embodiment shown, the eyelets 42 have a circular shape. However, the eyelets 42 can have any other appropriate configuration, shape and/or size.

An opening 46 is also defined in each side portion 30 in any area of the facing portion 38 (for example, in the instep region 36), sized to be able to slidingly receive one of the bands 18 therethrough, as will be detailed further below. In the embodiment shown, the opening 46 has an oblong shape; it is understood that the opening 46 can have any other appropriate shape, including, but not limited to, round, square, rectangular, triangular. In a particular embodiment, the opening 46 is positioned between two adjacent eyelets 42 and slightly below the row of eyelets. Other configurations are also possible.

Referring particularly to FIG. 1, the skate boot 12 further includes a tongue 40 extending from the toe portion 28 and bordering a front part of the foot receiving opening 34. The tongue 40 extends between the side portions 30 and is at least partially overlapped by the facing portion 38. When the foot is properly placed inside the boot shell 16, the tongue 40 can cover a substantial part of an instep region of the foot.

Referring back to FIGS. 1 and 2, the bands 18 are connected to the boot shell 16 at or adjacent a respective one of the side portions 30 (e.g. at heel portion 26, sole portion 20, toe portion 28). In the embodiment shown, the boot shell 16 is partly shown in transparency to show portions of the bands 18 located inside the boot shell 16. The bands 18 can have any appropriate shape, including, but not limited to, an elongated rectangular shape; alternately, the bands 18 may have a variable width across their length. In a particular embodiment, the bands 18 are formed from a non-stretchable material including, but not limited to, nylon and/or polyester. Alternately, the bands may be formed of stretchable material, or of a combination of stretchable and non-stretchable material.

In the embodiment shown, the two bands 18 are defined by separate strips of material. Each band 18 has a first end portion 48 received in the boot shell 16 and attached to the front of the boot shell 16, and a opposed second end portion 50. In the particular embodiment shown, the first end portion 48 of each band 18 is attached to the boot shell 16 at or adjacent the toe portion 28. For example, in the embodiment shown, the first end portion 48 of each band 18 is attached at a junction between the toe cap 28 and a respective side portion 30. Advantageously, in an embodiment where the side portions 30 are connected to the toe cap 28 by stitching, the first end portion 48 of each band 18 can be attached by one or more lines of stitching at the junction between the toe cap 28 and the respective side portion 30.

Figure 3:
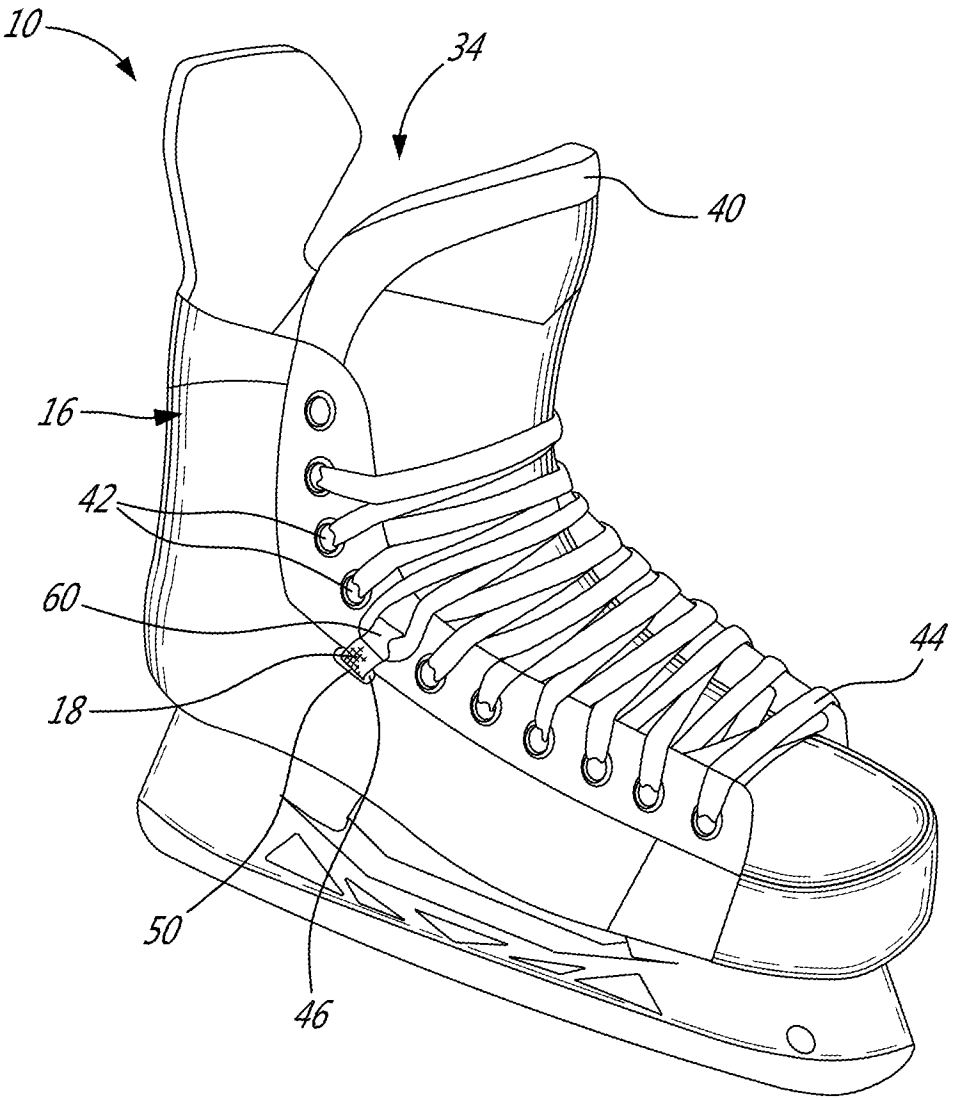
FIG. 3 is a schematic tridimensional view of the skate of FIG. 1, with a lace secured to the skate.

As can be seen in FIGS. 2-3, the bands 18 cross each other between the side portions 30, and, the openings 46 through the side portion 30 are located so that the bands 18 overlay the tongue 40 and cross each other over the tongue 40 (FIG. 3). In an alternate embodiment, the openings 46 through the side portion 30 are located so that the bands 18 extend under the tongue 40 (for example, in contact with the wearer's foot) and cross each other under the tongue 40.

Each band 18 extends across an interior 52 (FIG. 2) of the boot shell 16 from one side of the foot, or sole portion 20, to the other. In the embodiment shown, each band 18 extends from a point adjacent to one of the side portions 30 and is slidingly received through the opening 46 defined in the other one of the side portions 30 so as to have its opposed second end portion 50 extending outside of the boot shell 16. For example, one of the bands 18 extends from the left side portion 30A at the front of the boot shell 16 and through the opening 46 in the right side portion 30B of the boot shell 16, and the other band 18 extends from the right side portion 30B at the front of the boot shell 16 and through the opening 46 in the left side portion 30A of the boot shell 16.

Referring to FIG. 3, the second end portion 50 defines an aperture 60 to receive the lace 44. In the embodiment shown, the second end portion 50 of each band 18 forms a loop defining the aperture 60. Other configurations can also be used to provide the aperture 60 at the second end portion 50. For example, the second end portion 50 can include a mold-injected collar (not shown) attached to the material of the band 18, and defining the aperture 60 therein. The mold-injected collar can be made from a rubber material or the like. The opening 46 in the side portion 30 is located in proximity of the eyelets 42, i.e. sufficiently close to the eyelets 42 so that the lace 44 can be properly threaded into the apertures 60 of the band 18 extending through the opening 46 together with the eyelets 42, to allow the wearer to properly tighten the lace 44 in order to secure the boot shell 16 onto the foot. In one embodiment, threading the lace 44 include alternating the lace 44 through the eyelets across the side portions 30 and passing the lace 44 through each of the apertures 60 between two adjacent ones of the eyelets 42, as illustrated in FIG. 3. The aperture 60 thus replaces one of the standard eyelets 42; in a particular embodiment, the eyelets on each side of the aperture have a greater distance between them than the other adjacent eyelets of the row (e.g. twice the distance). Alternately, the eyelets, including the eyelets on each side of the aperture, may be regularly spaced apart.

Figure 4:
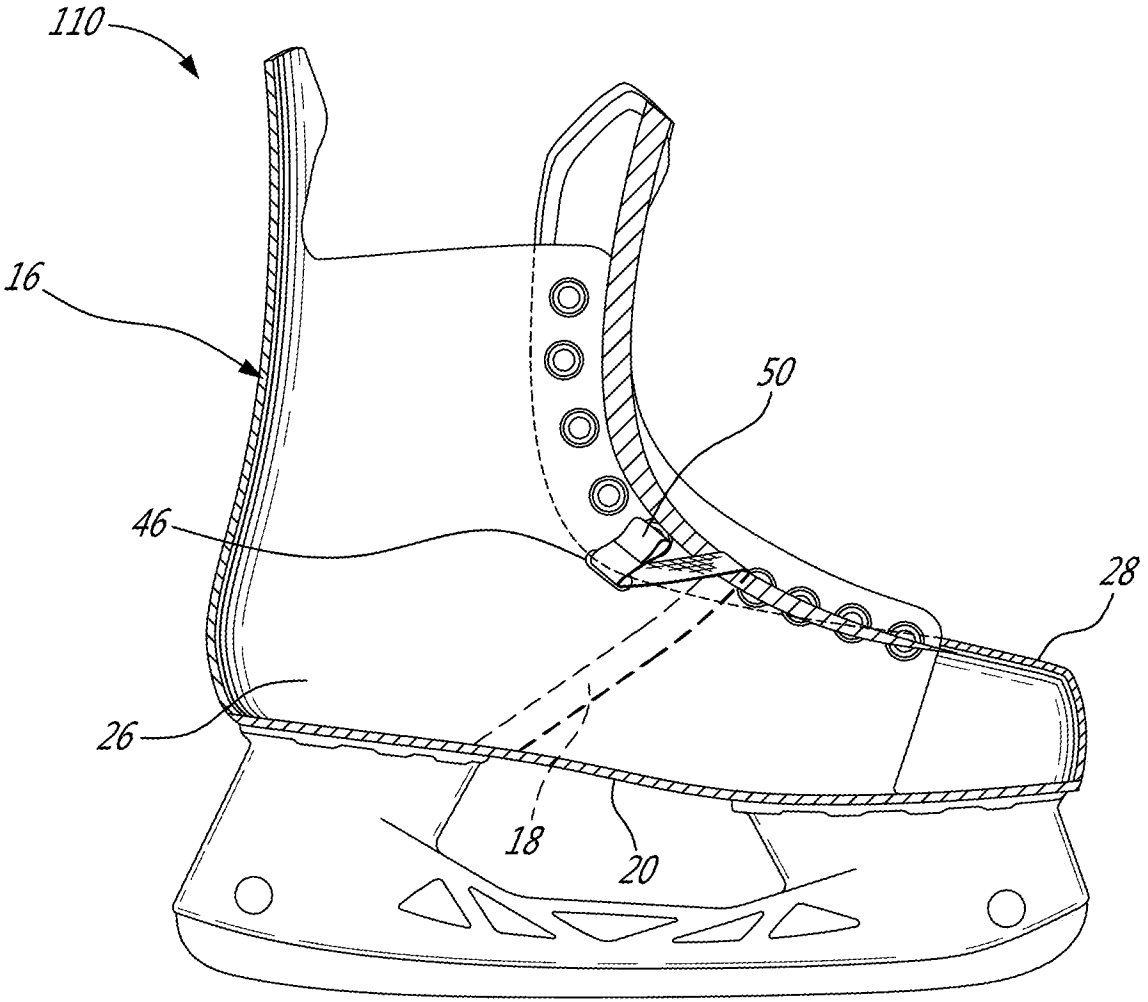
FIG. 4 is a schematic side view of a skate shown partly in transparency, in accordance with another particular embodiment.
Figure 5:
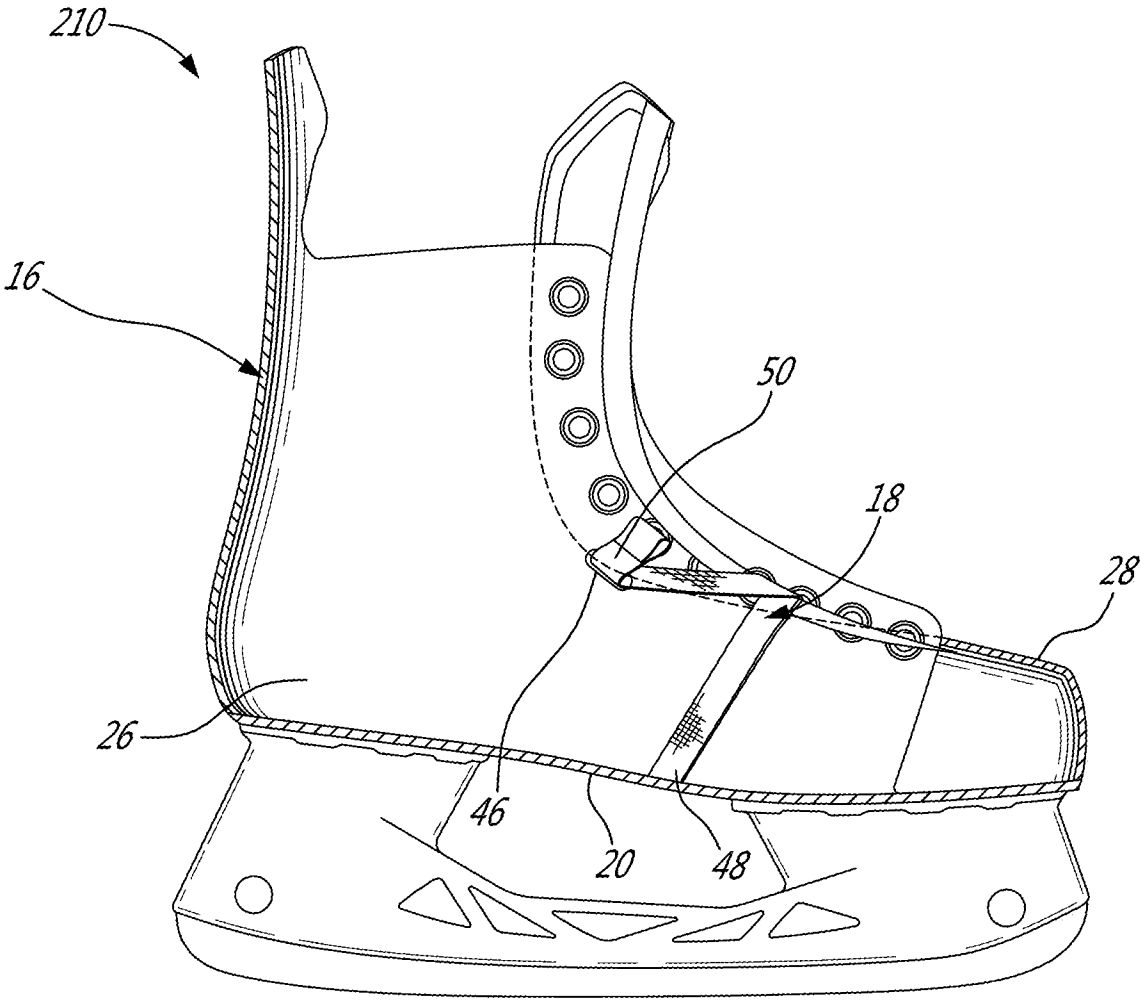
FIG. 5 is a schematic side view of a skate shown partly in transparency, in accordance with another particular embodiment.

Although the bands 18 have been shown with the first end portion 48 attached to the boot shell 16 at or adjacent the toe portion 28, it is understood that the bands 18 may alternately be attached to the boot shell 16 at other locations. For example, the bands 18 may be attached at any location along the lower portion of the boot 12. FIG. 4 shows an example of an alternate attachment configuration for the skate 110, where the first end portion 48 of each band 18 which is received in the boot shell 16 is attached in the lower portion of the boot 12 toward the rear of the boot 12, for example attached to the heel portion 26, to the side portion 30 adjacent the heel portion 26, and/or to the sole portion 20 adjacent the heel portion 26. FIG. 5 shows an example of another alternate attachment configuration for the skate 210, where the first end portion 48 of each band 18 which is received in the boot shell 16 is attached in the lower portion of the boot 12 intermediate the heel portion 26 and the toe portion 28, for example attached to the side portion 30 and/or to the sole portion 20. Alternately, the bands 18 may be attached in the facing of the boot shell 16, together with or in replacement of attachment in the lower portion of the boot 12.

Figure 6:
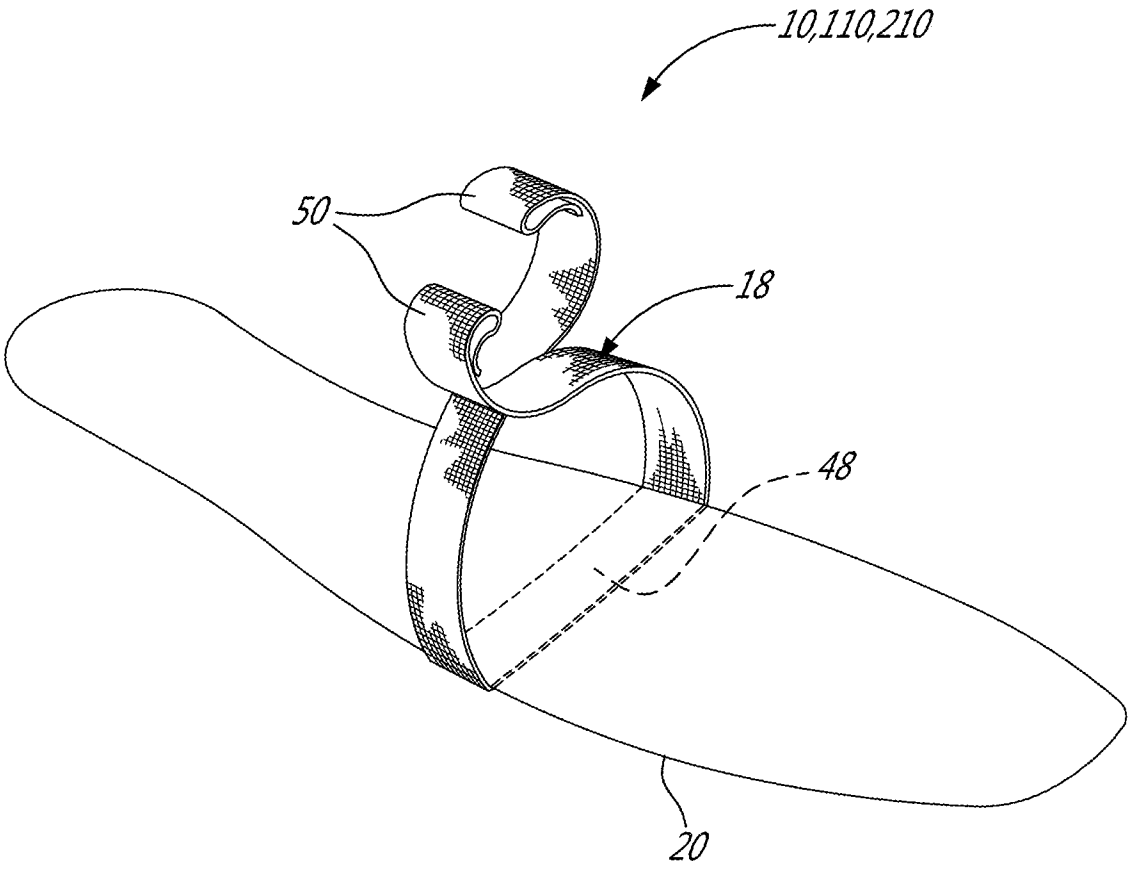
FIG. 6 is a schematic tridimensional view of a sole portion and bands of a skate in accordance with another particular embodiment.

Moreover, it is understood that the bands 18 can be formed by separate strips of material, or can alternately each be defined by a respective section of a same continuous strip of material, as illustrated by FIG. 6. As shown, the first end portions 48 of the bands 18 are connected to and continuous with one another, and extend across the sole portion 20 (over, under or embedded therein) between the side portions 30. For example, the continuous strip of material may extend under a midsole of the boot. The continuous strip configuration may be used with any of the described embodiments.

Figure 7:
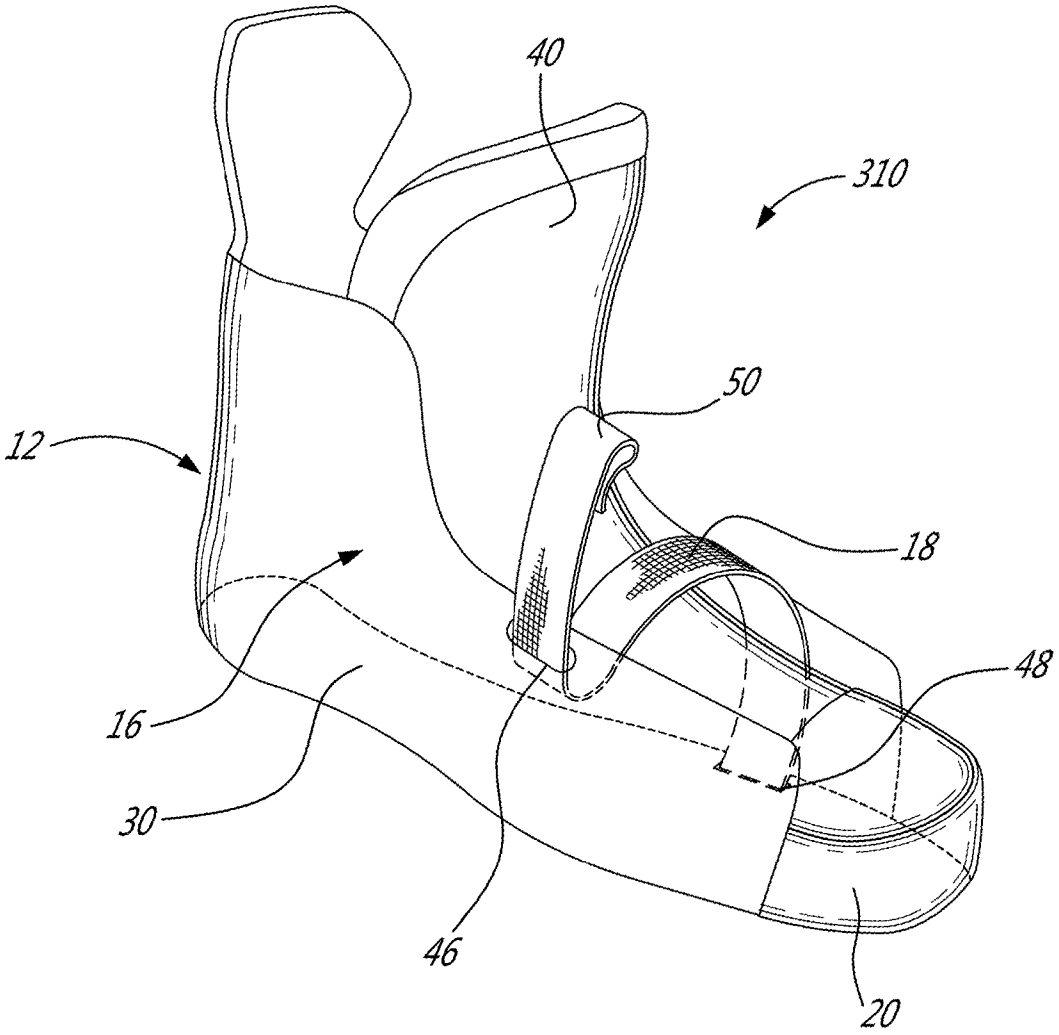
FIG. 7 is a schematic tridimensional view of part of a skate in accordance with another particular embodiment.

FIG. 7 illustrates another embodiment for the skate 210, where a single band 18 is provided. The first end portion 48 of the band 18 which is received in the boot shell 16 is attached in the lower portion of the boot 12, to the side portion 30, and/or to the sole portion 20. The band 18 extends across an interior of the boot shell 16 from one side of the foot to the other, under or over the tongue 40. The band 18 is slidingly received through the opening 46 defined in the opposed side portion 30 so that the second end portion 50 extends outside of the boot shell 16. The second end portion 50 may receive a lace between adjacent eyelets of the side portion 30 where the opening 46 is defined, or may extend back across the foot, for example over the tongue 40, to receive the lace between adjacent eyelets of the side portion 30 where the first end portion 48 of the band 18 is connected.

In use and in accordance with a particular embodiment, the wearer inserts his foot into the foot receiving opening 34 of the boot shell 16 and then tightens the lace 44 through the eyelets 42 and band aperture(s) 60 to support and secure his foot into the skate 10. Tightening the lace 44 through the eyelets 42 brings the side portions 30 closer toward each other thereby applying a compression force on the instep region of the foot. In a particular embodiment, tightening the lace 44 through the aperture(s) 60 of the band(s) 18 pushes the band(s) 18 (and, if the band(s) 18 overlap it, the tongue 40) further toward the sole portion 20 and against the foot, thereby applying an additional compression force on the foot of the wearer. In a particular embodiment, the band(s) 18 provide additional pressure on the foot to maintain it against the insole, as compared to the use of laces 44 alone. The additional pressure may be increased around the location of connection of the band(s) 18 with the boot shell 16, and accordingly the location of the connection may be selected based on the desired effect most beneficial for a particular activity. For example, having the band(s) 18 connected at or near the toe portion 28 may help maintain the front of the foot against the insole, in an area where traditional lacing may be less efficient.

In a particular embodiment, the skate 10 is manufactured by manufacturing the boot shell 16 through any suitable method (molding, lamination, forming using a last, etc.) and attaching one or more band(s) 18 inside the boot shell 16, for example in the lower portion of the boot shell 16 at any location described above. In a particular embodiment, two bands 18 are provided and each band 18 is attached to a respective side portion 30. For example, one of the bands 18 is attached to the left side and the other band 18 is attached to the right side of the boot shell 16. Each one of the bands 18 slidingly extends through the opening 46 defined in the opposite side portion 30 of the boot shell 16. For example, if the band 18 is attached to the left side of the boot shell 16, the band 18 extends through the opening defined in the right side of the boot shell 16. The apertures 60 formed on the second end portion 50 of each band 18 are positioned outside of the boot shell 16 near the respective opening 46 and adjacent eyelets 42.

Although the boot 12 has been described as a boot for a skate 10, it is understood that the boot 12 can alternately be a boot for any other suitable type of footwear, including, but not limited to, hiking boot, military boot, work boot, ski boot (with a ground engaging element suitable to engage a ski). The boot 12 can also have any other configuration suitable to receive and engage the foot.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A skate boot comprising:

a boot shell including first and second opposite side portions cooperating to define a foot receiving opening therebetween, each of the first and second side portions having a facing portion extending from the foot receiving opening; and a band having a first end portion received in the boot shell and attached to the boot shell at or adjacent the second side portion, the band extending across an interior of the boot shell and being slidingly received through a band-receiving opening defined in the first side portion so as to have a second end portion of the band extending outside of the boot shell, the second end portion of the band defining an aperture for receiving a lace therethrough.

2. The skate boot of claim 1, wherein a plurality of eyelets extend through the facing portion of the first and second sides portions of the boot shell, said band-receiving opening being one of the eyelets.

3. The skate boot of claim 2, wherein the band is a first band, the boot further comprising a second band, one of the eyelets in the second side portion of the boot shell forming a second band-receiving opening in the face portion of the second side portion, the second band-receiving opening configured to receive the second band therethrough, the second band having a first end portion received in the boot shell and attached to the boot shell at or adjacent the first side portion, the band extending across the interior of the boot shell and being slidingly received through said second band-receiving opening defined in the second side portion so as to have a second end portion of the second band extending outside of the boot shell, the second end portion of the second band defining an aperture for receiving the lace.

4. The skate boot of claim 3, further comprising a tongue extending between the first and second side portions, the first and second bands crossing each other over the tongue.

5. The skate boot of claim 3, wherein the first and second bands are each defined by a respective section of a same continuous strip of material extending across a sole portion of the boot shell and attached to the boot shell, the first end portions of the first and second bands being connected to and continuous with one another.

6. The skate boot of claim 1, wherein the boot shell includes a sole portion having opposed back and front ends and a toe portion extending from the front end of the sole portion, the first and second side portions being connected to the sole and toe portions, the first end portion of the band being attached to the boot shell in or adjacent the toe portion.

7. The skate boot of claim 6, wherein the toe portion is defined by a toe cap, the first end portion of the band being attached at a junction between the toe cap and the second side portion.

8. The skate boot of claim 1, wherein the second end portion of the band forms a loop defining the aperture.

9. The skate boot of claim 1, wherein the band is non-stretchable and is formed from at least one material selected from the group consisting of nylon and polyester.

10. The skate boot of claim 2, wherein the remaining eyelets form a row of eyelets in the facing portion in each of the first and second side portions, the band-receiving opening being offset from the remaining eyelets of the row of eyelets.

11. A skate comprising:

a boot shell having two side portions cooperating to define a foot receiving opening therebetween;

a ground-engaging assembly connected to a bottom of the boot shell; and two bands each having a first end portion received in the boot shell and attached to the boot shell, each band extending across an interior of the boot shell from a point adjacent a respective one of the two side portions and being slidingly received through an opening defined in the other one of the two side portions so as to have an opposed second end portion extending outside of the boot shell, the second end portion of each band defining an aperture for receiving a lace.

12. The skate of claim 11, wherein the two side portions of the boot shell include a plurality of eyelets extending therethrough, one of the eyelets forming the opening receiving the band and the remaining eyelets receiving the lace therethrough.

13. The skate of claim 12, wherein the lace extending through each one of the apertures in the second end portions of the two bands.

14. The skate of claim 11, wherein the first end portion of each of the bands is attached to a front of the boot shell.

15. The skate of claim 14, wherein the front of the boot shell includes a toe cap, the first end portion of each of the two bands being attached at a junction between the toe cap and the respective side portion of the boot shell.

16. The skate of claim 11, wherein the second end portion of each bands forms a loop defining the aperture.

17. The skate of claim 11, further comprising a tongue extending between the two side portions, the bands crossing each other over the tongue.

18. The skate of claim 11, wherein the bands are non-stretchable and are formed from at least one material selected from the group consisting of nylon and polyester.

19. The skate of claim 11, wherein the two bands are each defined by a respective section of a same continuous strip of material extending across a sole portion of the boot shell and attached to the boot shell, the first end portions of the two bands being connected to and continuous with one another to form a single, uninterrupted band.

20. The skate of claim 12, wherein the remaining eyelets form a row of eyelets in each of the two side portions, the opening being offset from the remaining eyelets of the row of eyelets.

* * * * *